United States Patent [19]

Sando et al.

[11] 4,102,158

[45] Jul. 25, 1978

[54] DRAIN DISPOSING DEVICE IN SEAL MECHANISM ON A CLOTH MATERIAL INLET SIDE OF HIGH PRESSURE STEAMER

[75] Inventors: Yoshikazu Sando; Hiroshi Ishidoshiro, both of Wakayama, Japan

[73] Assignee: Sando Iron Works Co. Ltd., Japan

[21] Appl. No.: 745,210

[22] Filed: Nov. 26, 1976

[30] Foreign Application Priority Data

Dec. 5, 1975 [JP] Japan ..... 50-145619

[51] Int. Cl.[2] ..... D06B 23/18

[52] U.S. Cl. ..... 68/5 E; 34/242

[58] Field of Search ..... 68/5 E; 34/242

[56] References Cited

U.S. PATENT DOCUMENTS

| | | | |
|---|---|---|---|
| 3,475,034 | 10/1969 | Hayashi | 65/5 E X |
| 3,651,671 | 3/1972 | Sando et al. | 68/5 E |
| 4,017,258 | 4/1977 | Sando et al. | 68/5 E X |

*Primary Examiner*—Philip R. Coe

*Attorney, Agent, or Firm*—Toren, McGeady and Stanger

[57] ABSTRACT

A drain disposing device in a seal mechanism on a cloth material inlet side of a high pressure steamer wherein there are provided a drain receiving tray which is disposed at a desired position on the inner circumferential surface of the seal mechanism and a drain guiding passage which communicates with the drain receiving tray for discharging the drain in the drain receiving tray to the inside of a drum body of the high pressure steamer or to the outside thereof.

1 Claim, 2 Drawing Figures

DRAIN DISPOSING DEVICE IN SEAL MECHANISM ON A CLOTH MATERIAL INLET SIDE OF HIGH PRESSURE STEAMER

BACKGROUND OF THE INVENTION

1. Field of the Invention

The present invention relates to a drain disposing device in a seal mechanism on the cloth material inlet side of a high pressure steamer.

High pressure steamers for high temperature, high pressure treatment of textile products such as cloth materials are well known. In a steamer of this type, however, the pressure and temperature have come to be set at 5 kg/cm$^2$ and 160° C or thereabout for operation. In order to maintain such a high temperature and a high pressure, an air seal mechanism is provided. However, the inside of such an air seal mechanism differs in temperature from the outside thereof and this causes waterdrops to gather inside the seal mechanism. These waterdrops then drip as drain.

When such dripping drain sticks to a cloth material which passes through the air seal, the drain causes unevenly dyed portions or uneven finishing of the cloth material. This results in a degraded quality of the cloth material as a product. This invention is directed to the elimination of the above stated drawback of the conventional high pressure steamer.

SUMMARY OF THE INVENTION

It is therefore an object of this invention to provide a drain disposing device for a high pressure steamer wherein drain receiving trays are disposed on the inner circumferential surfaces of a seal mechanism on the inlet side of the steamer and drain guide passages which communicate with the drain receiving trays to discharge drain collected inside the drain receiving trays either to the inside of a drum body of the steamer or to the outside of the steamer. With the invented drain disposing device employed, the waterdrops that gather on the inner circumferential surface of the seal mechanism are completely prevented from dripping onto the cloth material being processed. The drawback of the conventional high pressure steamer is eliminated by this.

DETAILED DESCRIPTION OF THE INVENTION

The details of this invention will become apparent from the following description of embodiment examples with reference to the accompanying drawings.

EXAMPLE 1

Figure 1:
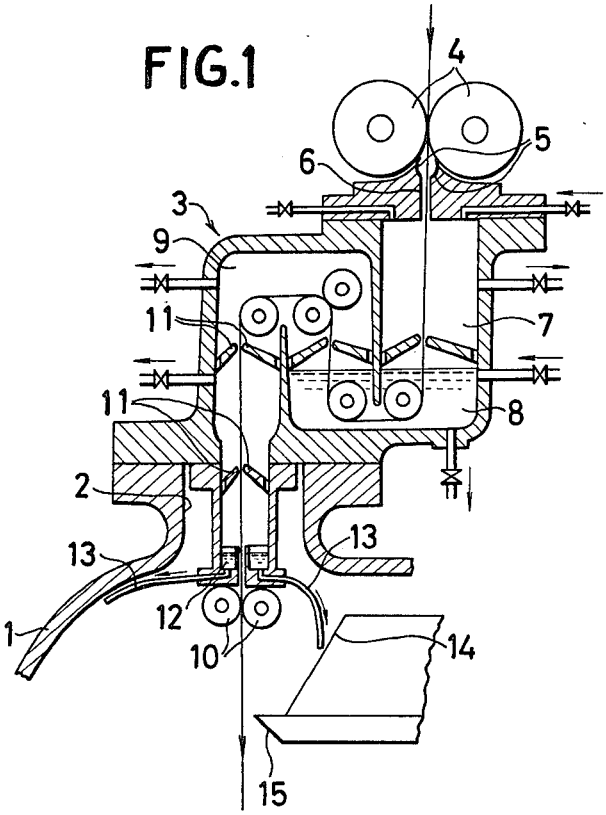
FIG. 1 is a sectional view of a seal mechanism which represents a first embodiment of this invention.

In FIG. 1 which illustrates, as, an embodiment, example, an entrance side seal mechanism having a liquid seal tank, a reference numeral 1 indicates a drum body of a high pressure steamer; and 2 indicates a cloth material inlet port. To this inlet port 2 is secured a seal mechanism 3. In the uppermost part of the seal mechanism, there is provided a seal member comprising rubber rolls 4 and a flexible resilient plate 5 formed either by a rubber or metal plate. The seal member closes an upper opening of a cloth passage 6. A reference numeral 7 indicates a first pressure reducing chamber which communicates with the lower side of the cloth passage 6. A U-shaped liquid seal tank 8 is formed beneath the first pressure reducing chamber 7. A second pressure reducing chamber 9 is formed following the liquid seal chamber 8. The opening of the second pressure reducing chamber 9 on the cloth material exit side is closed by a pair of auxiliary seal rolls 10. Reference numerals 11 indicate pairs of drain receiving trays which are formed on the inner surface of the second pressure reducing chamber 9. With these drain receiving trays 11 disposed there, the pressure reducing effect in the pressure reducing chamber 9 can be enhanced stepwise. The drain collected in each drain receiving tray 11 flows down along the inner wall surface of the pressure reducing chamber 9 to be collected in a drain sump 12. The drain collected in the drain sump is allowed to flow by passages 13 along the inner circumferential surface of the drum body 1 or along a peripheral gutter 15 of a drip board 14 down to the bottom of the drum body 1.

Therefore, according to this invention, the drain resulting from the waterdrops gathering on the wall surface inside the seal mechanism of a high pressure steamer is arranged to flow along the drain receiving trays and wall surface and is thus prevented from dripping onto the cloth material being processed. Thus the feedback of the conventional high pressure steamer is eliminated.

EXAMPLE 2

Figure 2:
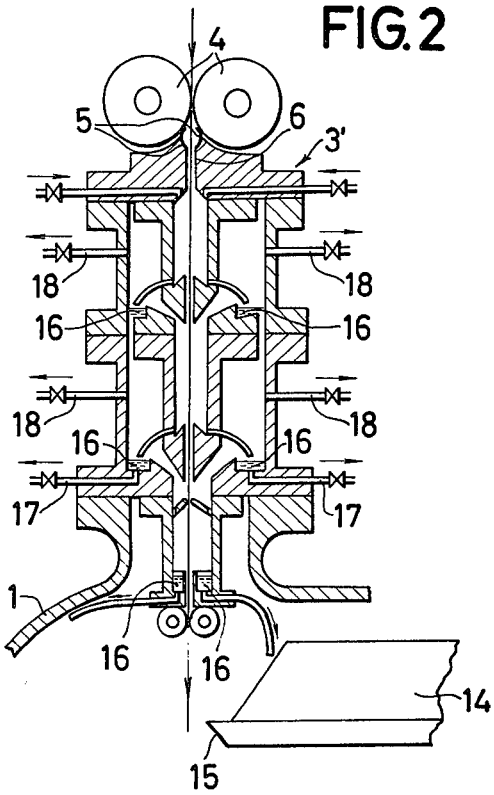
FIG. 2 is also a sectional view of another seal mechanism which represents a second embodiment of the invention.

FIG. 2 illustrates, as another embodiment example, an arrangement for removing the drain of a seal mechanism 3' which comprises a multistage arrangement of pressure reducing chambers. In this embodiment, the drain in each pressure reducing chamber is collected in a drain receiving sump 16. The drain in the drain receiving sump 16 is allowed to flow down along the inner wall of the pressure reducing chamber. Then, the drain which has flowed down may be discharged through drain pipes 17 either to the outside of the steamer or to the inner bottom of the drum body 1 in the same manner as in Example 1. However, in this example, the drain in the pressure reducing chambers in the upper and middle stages is discharged to the outside through drain pipes 17 while the drain in the pressure reducing chamber of the lower stage is guided to the inner bottom of the drum body 1. In this example, exhaust pipes 18 are provided separately from the drain pipes 17. However, it is possible to make piping for combined purposes of serving as exhaust pipes and also as drain pipes, instead of making such exhaust piping separately from drain piping.

As described in the foregoing, in accordance with this invention, the drain which gathers inside the seal mechanism can be successively collected and recovered to effectively prevent dripping of the drain onto the cloth materials being processed. With the invented drain processing device, therefore, it is possible to carry out a high pressure humid heat treatment of a cloth material without fear of the uneven dyeing and the quality degradation which otherwise tend to result from such dripping of drain.

What is claimed is:

1. A seal mechanism for the cloth material inlet side of a high pressure steamer comprising first means forming an enclosed passageway having a first opening for admitting cloth into the passageway from the exterior of said mechanism and a second opening for admitting cloth from the passageway into the high pressure steamer, second means for sealing each of said first and second openings, third means for dividing said passageway between the sealed first and second openings into a plurality of serially arranged pressure reducing chambers, drain receiving trays located within at least one of said pressure reducing chambers and extending transversely of the direction of movement of cloth material through said passageway from the first opening to the second opening, said drain receiving trays subdividing at least the one of said pressure reducing chambers for enhancing the stepwise pressure reducing effect within said pressure reducing chamber, said drain receiving trays arranged to collect drain in said pressure reducing chamber within which they are located and to lead the drain away from the cloth passing through the passageway to the inside surfaces of said pressure reducing chamber, fourth means for collecting the drain within said passageway and for keeping the drain away from the cloth therethrough, and fifth means forming drain guiding passages in communication with said fourth means for discharging the drain collected from said drain receiving trays to one of the interior of the high pressure steamer and the exterior of said seal mechanism located exteriorly of the high pressure steamer.

* * * * *